United States Patent [19]

Landsman

[11] 4,056,110

[45] Nov. 1, 1977

[54] COMBINATION BRUSH AND PASTE DISPENSER

[76] Inventor: Emanuel Landsman, 245 N. Broadway, Yonkers, N.Y. 10701

[21] Appl. No.: 733,824

[22] Filed: Oct. 19, 1976

[51] Int. Cl.[2] ..... A45D 44/18

[52] U.S. Cl. ..... 132/84 R; 401/107

[58] Field of Search ..... 132/84 R; 401/62, 107, 401/122, 127, 129, 158–160, 183, 163

[56] References Cited

U.S. PATENT DOCUMENTS

| | | | |
|---|---|---|---|
| 1,464,250 | 8/1923 | Lieberthal | 132/84 R |
| 2,253,514 | 8/1941 | Fisher | 401/107 |
| 2,284,217 | 5/1942 | Lieberthal | 132/84 R |
| 2,960,092 | 11/1960 | Francolino | 132/84 R |

*Primary Examiner*—G.E. McNeill

*Attorney, Agent, or Firm*—Allison C. Collard

[57] ABSTRACT

A combination brush and paste dispenser for dispensing a measured amount of paste from a tube having a hollow elongated housing with a hinged outlet cover mounted on one end so that a brush with a handle can exit from that end. There is a first compartment in the housing for receiving the tube of paste which is connected to a paste applying means at the end of the housing adjacent to the hinged cover. There is also provided a carriage slidably disposed in the housing, having a compression paddle which presses against the side of the tube in response to movements of the brush and handle. The paddle is automatically indexed inward against the side of the tube as the brush is used so that paste is continuously applied to the brush for each use. In another embodiment, a lead screw is provided with a sliding clamp against the back of the tube so that the paste can be applied manually instead of automatically as in the first embodiment.

12 Claims, 23 Drawing Figures

10
11
15
30
24
56
57
63
9
36
32
12
37
40
14
61
13
8
62
33
65
17
16
31
39
62
19
20
18
22
21
27
34
58
25
52
51
67
51
52
68
23
28

CLOSED
OPEN

COMBINATION BRUSH AND PASTE DISPENSER

This invention relates to a combination brush and paste applicator.

More specifically, this invention relates to a brush and paste dispenser capable of containing a tube of paste, such as toothpaste, and intermittently applying the paste to a brush which is alternately exposed and retracted in the applicator.

In applications where it is necessary to apply a paste from a tube onto a brush, there are a number of conventional dispensers available which generally squeeze the tube of paste in response to the turning of a lead screw or other mechanism. These devices are generally wall mounted and contain the tube of paste within the housing that has a travelling squeezing mechanism. One end of the housing is exposed so that the paste will exit from an opening in response to pressure applied to the tube from a mechanical device. In the case of toothpaste, the user must hold his toothbrush adjacent to the outlet of the dispenser while the paste is applied to the bristles of the brush. Most of the prior art devices suffer from the disadvantages in that they are not portable and require a separate external brush to be hand-held while the paste is being applied.

Accordingly, the present invention provides a combination of a paste and brush device wherein the paste is automatically applied to the brush each time the brush is extended and retracted. In one embodiment, as the brush is moved, a paddle will also move and apply pressure to the walls of the flexible tube containing the paste so that a measured amount of paste will be applied to the bristles as the brush is exposed for use. In another embodiment, a lead screw is used to move a compression vise along the axis of the tube a measured distance, so that a predetermined amount of paste will be squeezed from the tube onto the bristles of the brush each time the brush is used.

It is therefore an object of the present invention to provide a combination brush and paste dispenser which is capable of automatically placing a measured amount of paste onto the bristles of the brush before the brush is used.

It is another object according to the invention to provide a combination brush and paste dispenser which is simple in design, easy to manufacture and reliable in operation.

Other objects and features of the present invention will become apparent from the following detailed description when taken in connection with the accompanying drawings which disclose two embodiments of the invention. It is to be understood, however, that the drawings are designed for the purpose of illustration only and not intended as a definition of the limits and scope of the invention disclosed.

In the drawings, wherein similar reference numerals denote similar elements throughout the several views.

Figure 1:
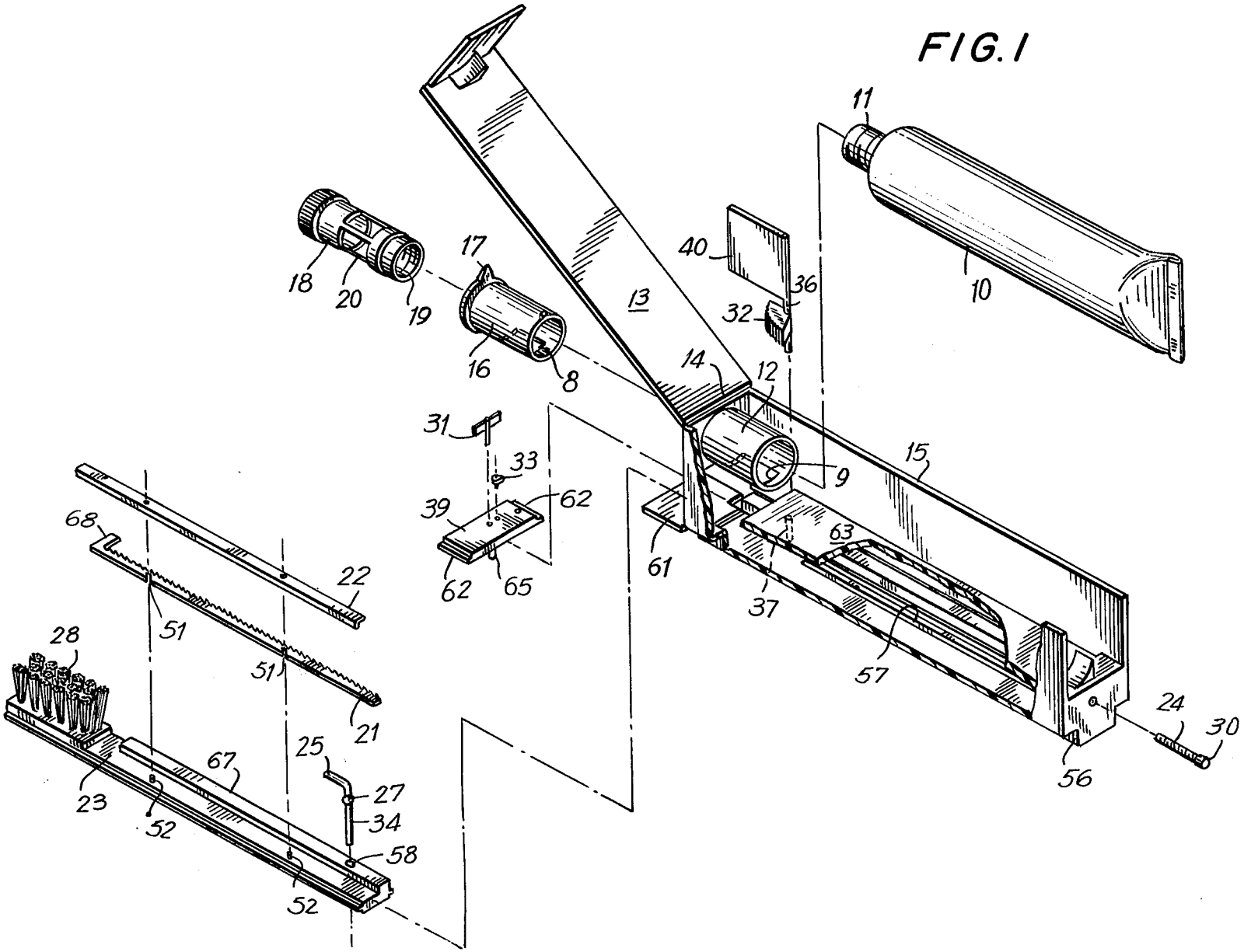
FIG. 1 is an exploded view of the combination brush and paste dispenser according to the invention.

Referring to FIG. 1, there is shown an exploded view of the combination brush and paste dispenser 15 which consists of a hollow housing capable of receiving a tube 10 of paste having an outlet nozzle 11 for insertion into a cylindrical sleeve 12 mounted at one end of the housing. A cover 13 is provided which is connected by means of hinge 14 to housing 15. A second cylinder 16 containing a pointer 17 formed at one end is fitted into cylinder 12 from the front of the dispenser and its opening 8 can be disposed in registration with opening 9 of cylinder 12. A third cylinder 18 having a knurled knob at one end and internal threads 19 at the opposite end is screwed onto threads 11 at the outlet of tube 10 after being passed through the hollow opening in the front of cylinder 16. Cylinder 18 includes a plurality of openings 20 which also fall in registration with openings 8 and 9. By tightening cylinder 18 onto threads 11 of tube 10, cylinders 16 and 18 are then captured within cylinder 12 of housing 15. The applicator brush with bristles 28 is mounted on a base 23 which also includes a toothed rack 21 and a cover plate 22 positioned over the rack on handle 23. Small oblique slots 51 are formed in the body of rack 21 as shown in detail in FIG. 6 so that the rack is free to slide on pins 52 which are anchored to brush handle 23.

Figure 12:
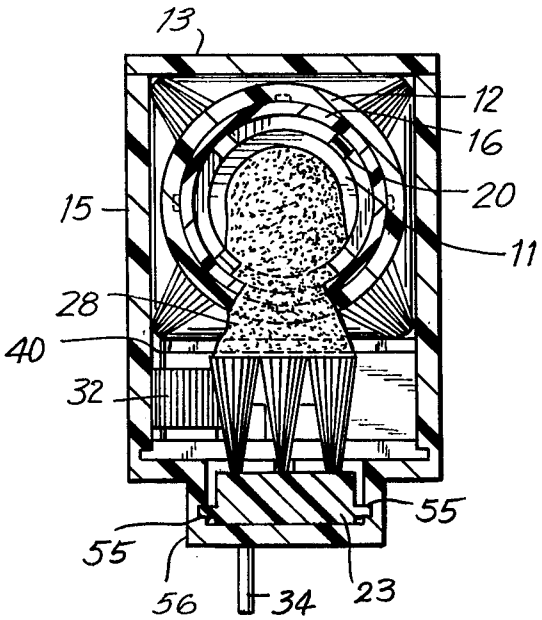
FIG. 12 is an end cross-sectional view showing the application of paste onto the bristles of the brush.
Figure 14:
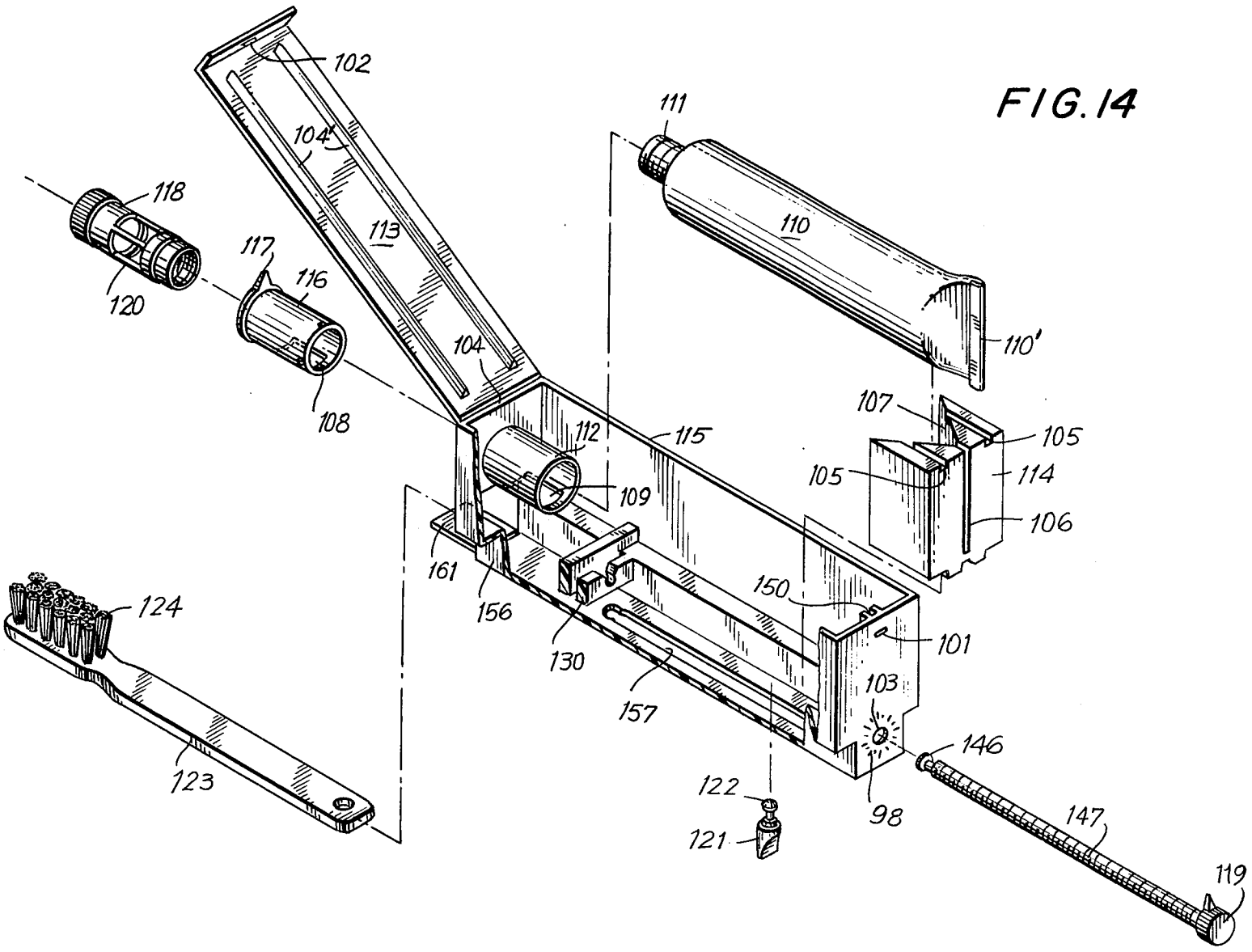
FIG. 14 illustrates a second embodiment of the invention using a sliding vise responsive to a lead screw for a combination brush and paste dispenser.
Figure 15:
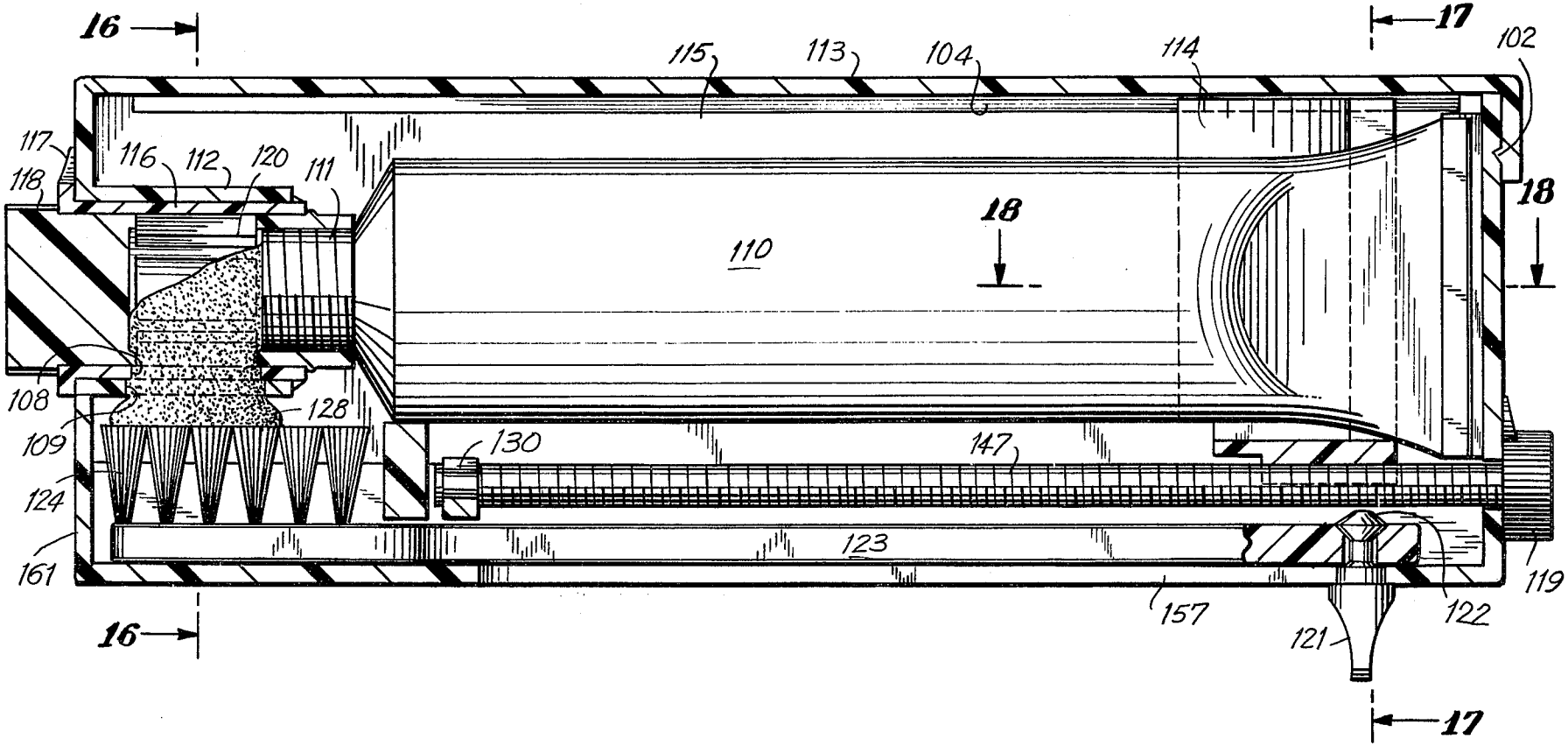
FIG. 15 is a cross-sectional view of the embodiment of FIG. 14.
Figure 17:
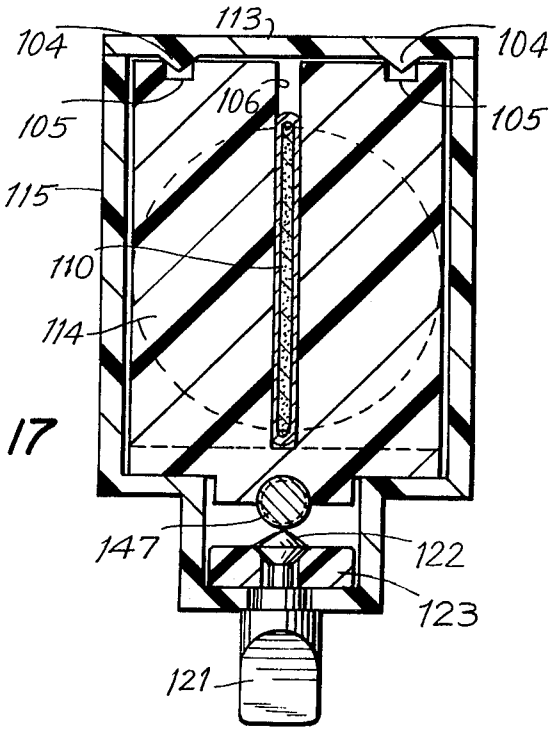
FIG. 17 is a cross-sectional view taken through section 17—17 of FIG. 15.

Brush handle 23 contains longitudinal rails 55 formed on each edge as shown in detail in FIG. 12. Rails 55 fit into corresponding longitudinal slots formed in compartment 56 along the bottom of housing 15 so that the brush can slide freely in and out of the housing. The bottom compartment 56 of housing 51 is also provided with a longitudinally extending slot 57 as shown in FIG. 1, which accommodates a pin 34 that connects into an opening 58 formed adjacent to the end of handle 23. Knob 34, as shown in detail in FIGS. 1 and 2, contains an expansion ball 27 which frictionally fits into hole 58 for gripping and engaging the handle. One end of pin 34 is bent at a right angle 25 above handle 23.

Figure 2:
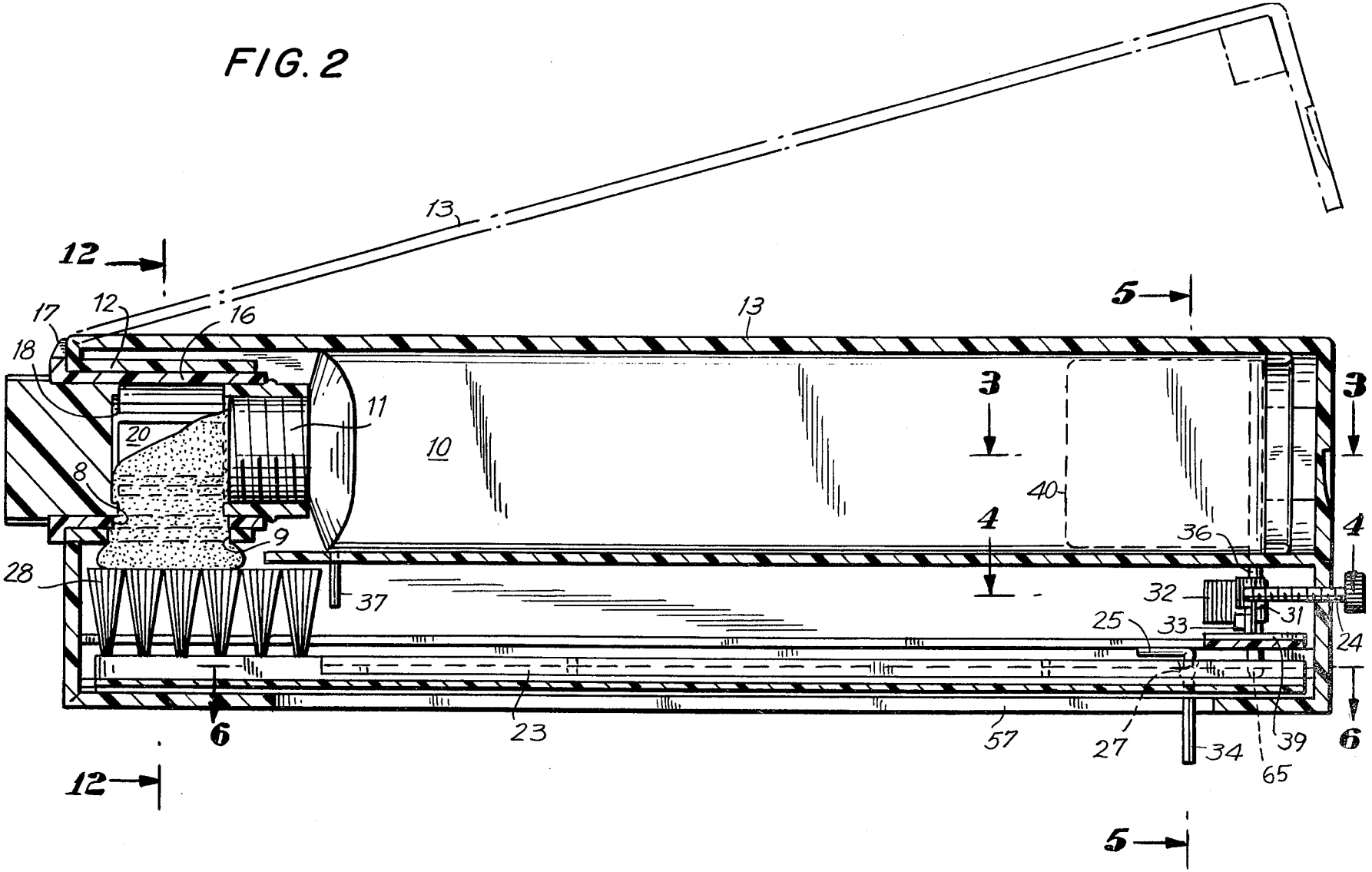
FIG. 2 is a cross-sectional view taken through the longitudinal section of the combination brush and paste dispenser.
Figure 5:
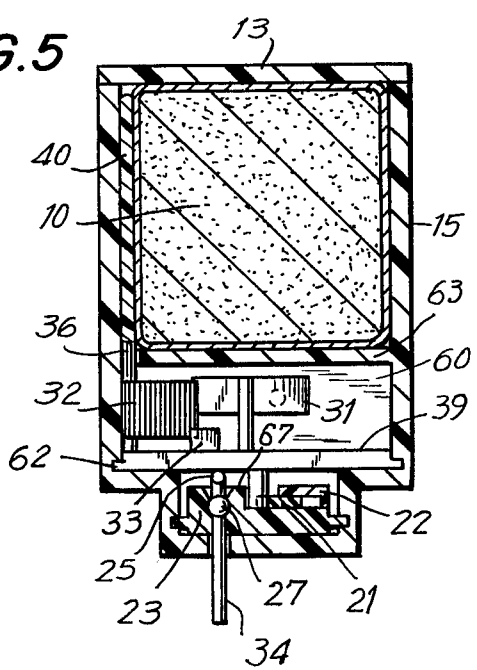
FIG. 5 is a cross-sectional view taken along section 5—5 of FIG. 2.
Figure 4:
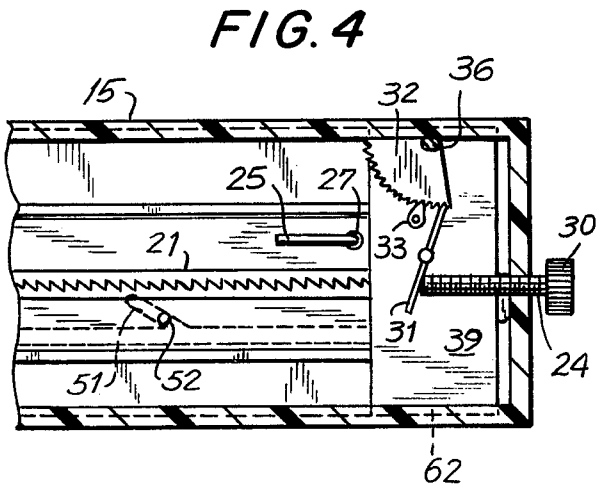
FIG. 4 is a cross-sectional view taken along section 4—4 of FIG. 2.
Figure 8:
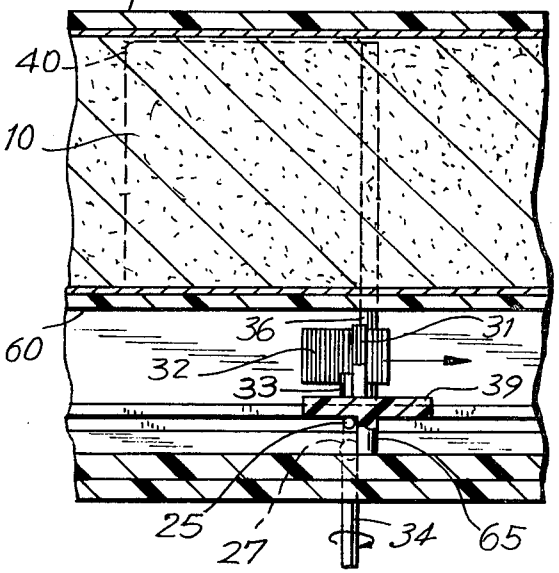
FIG. 8 is a side view of the dispenser showing the release mechanism for the brush and the pressure paddle.

Disposed in the center compartment area 60 of housing 15 is a carriage plate 39 as shown in FIGS. 1, 5 and 8, which also has side rails 62 adapted to fit into corresponding grooves formed within the walls of housing 15. The carriage plate is thus free to move along the length of the housing. Pivotably mounted on the surface of carriage plate 39 is a butterfly paddle 31 which has an end engaging a ratchet segment 32 as shown in detail in FIG. 4. Ratchet segment 32 also includes a pivot 16 coupled to carriage plate 39. A pawl 33 pivoted into carriage plate 39 is also engaged to the teeth of ratchet 32. The other end of axis 36 extends through an elongated slot formed in floor 36 as shown in detail in FIG. 5 and connects to a compression paddle 40 which is designed to engage one of the slides of flexible tube 10. Disposed through the back wall of housing 15 is a threaded screw 24 terminating in a knurled knob 30 and designed to engage butterfly paddle 31 when carriage 39 is in its position as shown in FIG. 4 adjacent to the back wall of housing 15. A second stop 37 is mounted on floor 63 of housing 15 as shown in FIG. 2 and is designed to engage the opposite side of butterfly paddle 31 when the carriage has advanced to the other end of housing 15 as shown in detail in FIG. 10. A door 61 which is pivoted at the front end of housing 15 is designed to open when the brush is slid forward to be exposed.

Figure 3:
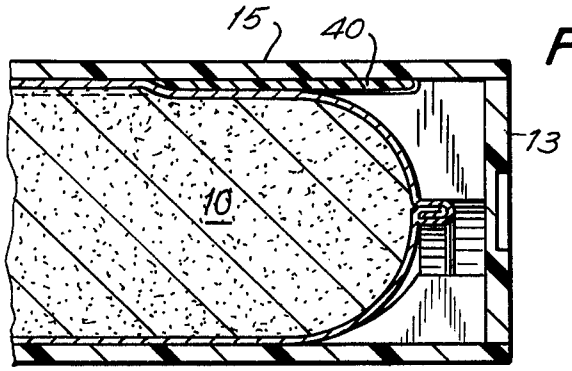
FIG. 3 is a cross-sectional view taken along section 3—3 of FIG. 2 showing the rear of the dispenser.
Figure 6:
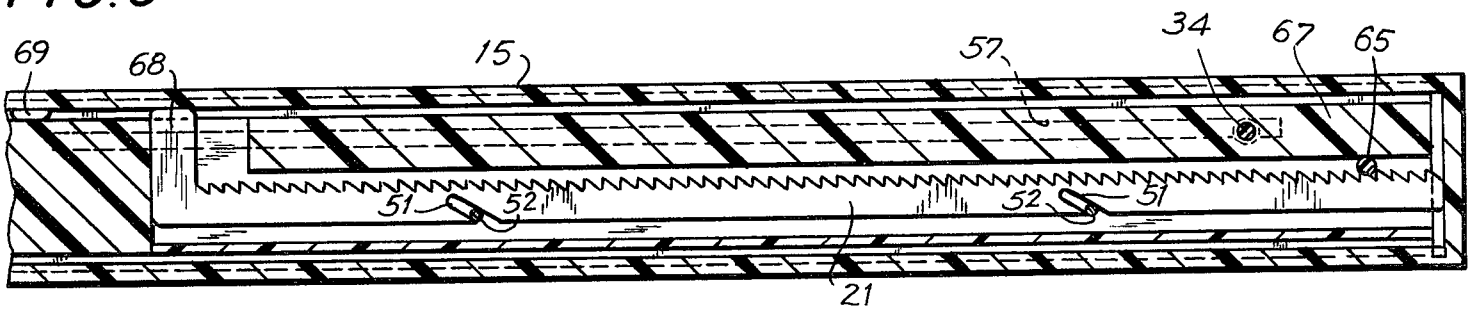
FIG. 6 is a cross-sectional view taken along section 6—6 of FIG. 2.
Figure 7:
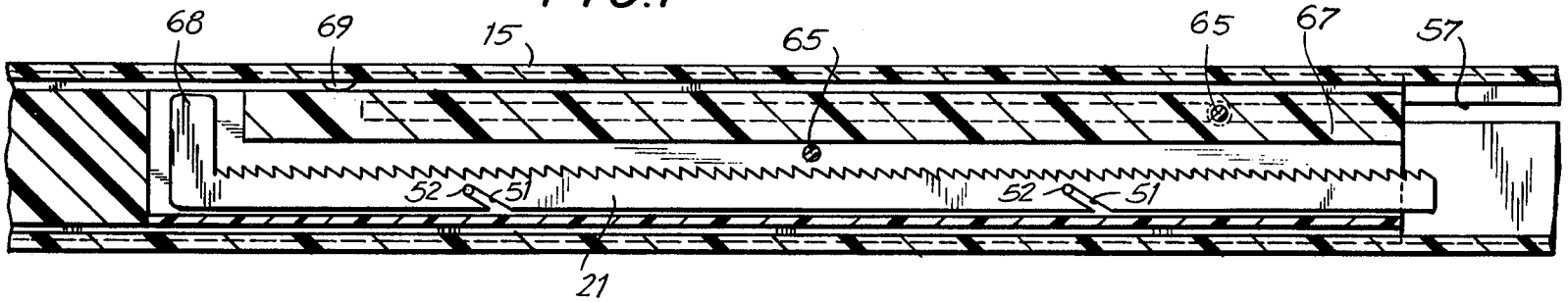
FIG. 7 is a plan view of a toothed rack in combination with the brush according to the invention.

The device of this embodiment operates as follows:

Carriage 39 is initially set in a position adjacent to the nozzle 11 of tube 10 as the tube is inserted in the housing, and the brush is retracted in the apparatus. The user pushes pin 34 towards the front of housing 15 and brush handle 23 will slide forward and exit out of the opening defined by cover 61 at the front end of housing 15. When the brush is fully extended, it will engage carriage 39. Then, when the brush is returned back into the housing, carriage 39 and compression paddle 40 will return back to the rear of tube 10. Then, the brush and handle are once again pushed out of the housing. A pin 65, as shown in FIGS. 2 and 6 are engaged into toothed rack 21 and shoulder 67, so that sliding carriage 39 will compression paddle 40 will also move forward along the side of flexible tube 10 as shown in FIG. 3, causing paste to be forced out of tube 10 through opening 11 and through a combination of openings 8, 9 and 20 onto bristles 28 as shown in FIG. 12. As the brush is further moved out of housing 15, the L-shaped end 68 of toothed rack 21 engages a cam projection 69 as shown in FIGS. 6 and 7 which causes toothed rack 21 to be displaced away from pin 65 as shown in FIG. 7 and release the pin after pressure paddle 40 has travelled a predetermined distance along the side of flexible tube 10. Thus, each forward movement of the brush will cause toothed rack 21 to grip pin 65 and advance the carriage a further increment until the carriage reaches a position adjacent to the end of the tube near outlet 11.

Figure 11:
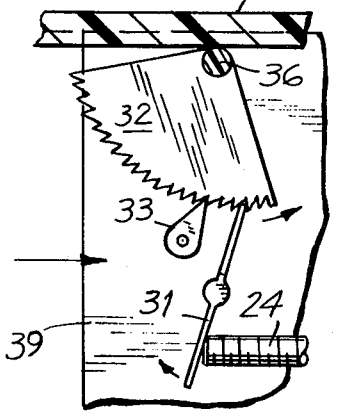
FIG. 11 shows the pawl and ratchet combination after hitting a rear screw stop.
Figure 10:
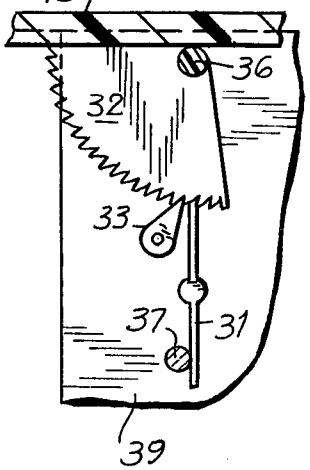
FIG. 10 shows the pawl and ratchet combination after hitting a forward stop.
Figure 9:
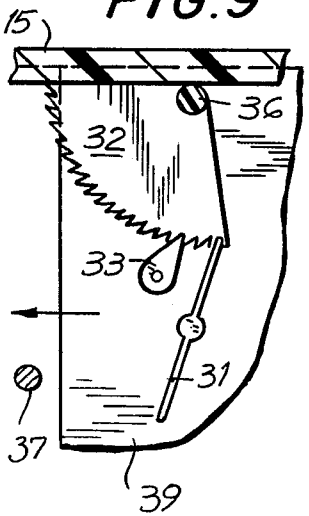
FIG. 9 shows a pawl and ratchet combination mounted on a movable carriage for advancing the pressure paddle small increments of angular displacement.
Figure 13:
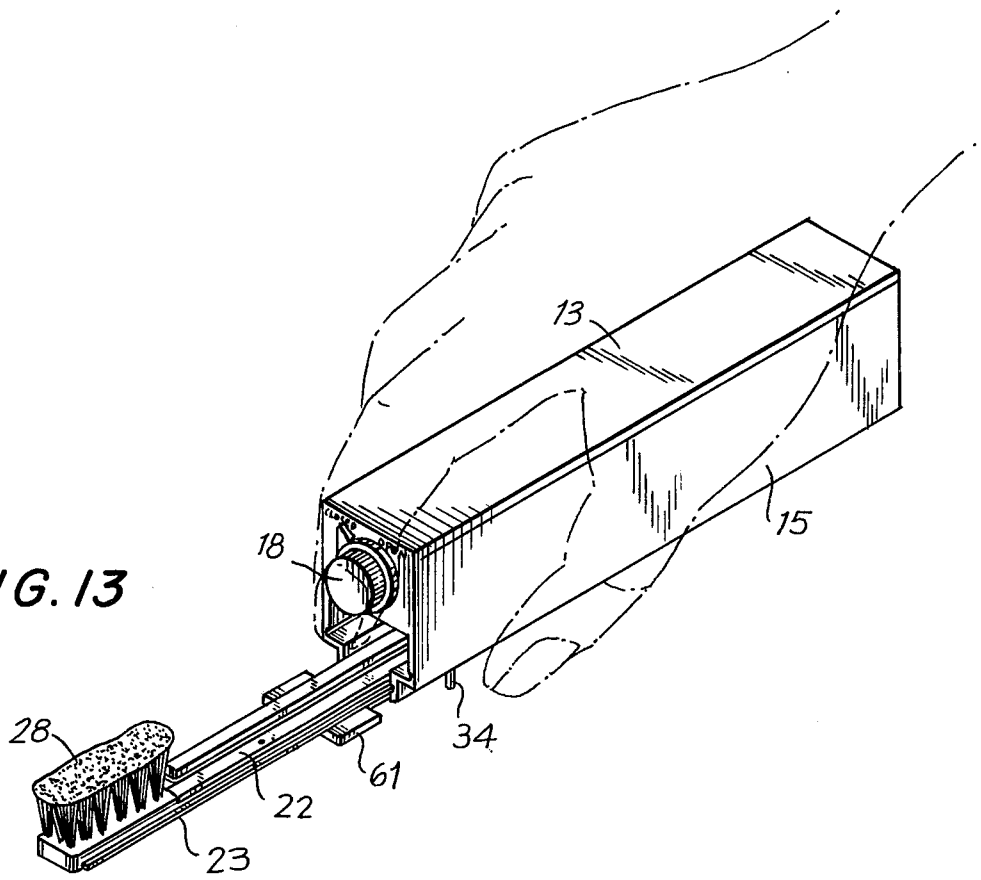
FIG. 13 is an isometric view showing the brush and paste dispenser with the brush exposed.

FIG. 9 shows the initial position of ratchet segment 32 with respect to pawl 33 and butterfly paddle 31 as the carriage advances toward the outlet of tube 10. When the carriage reaches the end of its travel, butterfly paddle 31 engages a stop 37 which is mounted on floor 63 as shown in FIG. 1, so that the butterfly paddle will advance one or two tooth positions as shown in FIG. 10. Pawl 33 will hold ratchet segment 32 stationary during this advancement. While the brush handle 23 and the brush are in their fully extended position and carriage 39 has reached the end of its travel, the user can push pin 34 so that pin end 27 will engage carriage 39 and allow the carriage to be returned to the back wall of housing 15 as the brush is retracted back inside the housing. As the carriage approaches the back wall of housing as shown in FIG. 11, the end of screw 24 will contact one side of butterfly paddle 31 and cause ratchet segment 32 to pivot counterclockwise as shown by the arrow on its pivot 36. Pawl 33 will skip over one or two tooth segments and lock ratchet 32 into a new angular position. The movement of tooth rack 32 will also displace pressure paddle 15 counterclockwise against the side of tube 10, so that the next travel of carriage 39 along the length of housing 15 will compress the walls of the tube further to force the additional contents of the tube onto the brush. It is obvious that if screw 24 were to be turned inward, ratchet segment 32 would then be advanced a greater angular displacement and more of the contents of tube 10 could be applied to the brush.

FIGS. 14–21 show still a further embodiment of the invention of a combination brush and paste dispenser. Referring to all of these FIGS., there is shown a tube 110 having an outlet 111 placed into housing 115 so that its outlet is fitted into cylinder 112 and cylinders 116 and 118 are engaged to the threaded end 111 of tube 110 in a manner similar to the first embodiment. The cylinders contain contiguous openings 108, 120 and 109, so that the contents can flow through these openings into bristles 124 mounted on the end of brush handle 123. The housing in a manner similar to the first embodiment has a cover 113 which is connected to housing 115 by means of hinge 104 and is capable of closing down and snapping shut by means of detent 101 and a tab 102 in the cover. The cover also includes rails 104' which are designed to fit into grooves 105 that are formed in the top surface of a sliding clamp 114 that is disposed in housing 115. Sliding clamp 114 includes a slot 106 and V-shaped compression surfaces 107 so that the clamp can aqueeze the walls of the tube 110 as it moves towards the front of the housing. Slot 106 is slightly larger than the width of two wall thicknesses of the tube so that as the tube is compressed as shown in detail in FIGS. 17 and 18, the walls will almost meet in full compression. A slot 150 is provided on the inside portion of the back wall of housing 115 so as to receive the pinched-over clamped end 99 of tube 110. The sliding wedge clamp 114 is advanced along the housing by means of a lead screw 147 which is inserted through an opening 103 at the end of the housing. An annular slot 146 formed at one end of lead screw 147 fits into a supporting yoke 130 mounted within the housing in order to prevent the lead screw from any axial displacement. The other end of the lead screw is capped with a knurled knot 119 having a pointer so that the user can determine the amount of rotation and thus the amount of contents of tube 110 to be applied to the brush by means of the pointer and graduations 98 embossed on the back of the housing.

Figures 19, 20, 21:
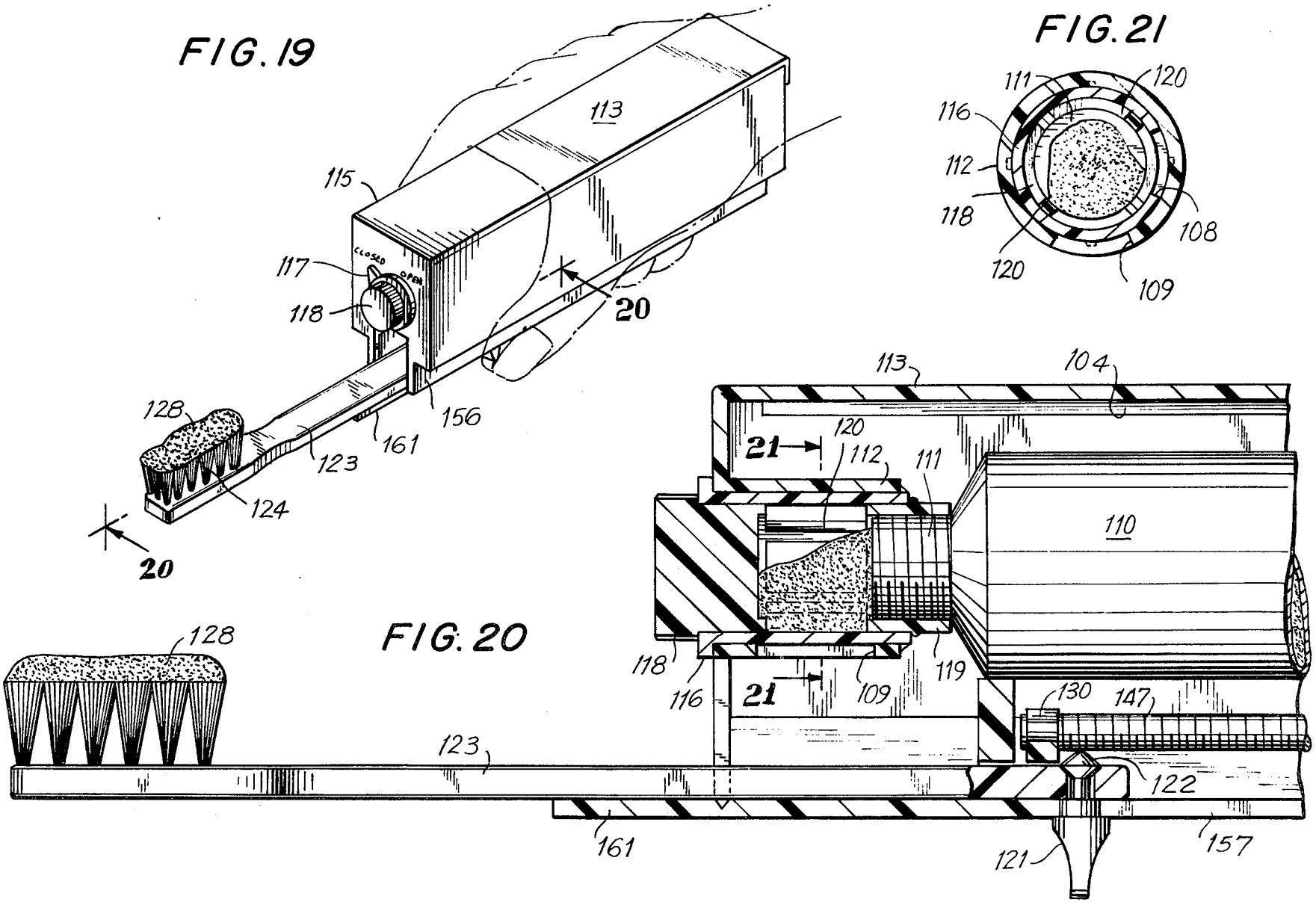
FIG. 19 is an isometric view of the embodiment of FIG. 14 with the brush extended.
FIG. 20 is a cross-sectional view taken through section 20—20 of FIG. 19.
FIG. 21 is a cross-sectional view taken through section 21—21 of FIG. 20.

The brush and handle 123 are designed to slide along the bottom of housing 115 and are engaged by means of a thumbpiece 121 having a resilient tip 127 which is designed to fit through the hole formed in the end of the brush. The brush used in this embodiment may be a standard toothbrush having a hole formed at one end. Housing 115 also includes an elongated slot 157 formed in its bottom to accommodate the sliding of thumbpiece 121 and handle 123 when the brush is in its fully extended position as shown in FIG. 20. In a manner similar to the first embodiment of the invention, a pointer 117 is provided on the front surface of housing 115 with a closed and opened position. In the closed position, cylinder 116 can be connected to the pointer to close off the input of the contents from tube 110 so that they are prevented from reaching bristles 124 of the brush. When the pointer is rotated to the opened position, cylindrical openings 109, 108 and 120 fall into alignment so that the contents of the tube will then be communicative to the brush bristles.

In operation, the user will rotate lead screw 147 by turning knob 119 in a clockwise position, so that sliding wedge or vise 114 will advance along the surface of tube 110, pushing out some of the contents of the tube into cylinders 116 and 112. If pointer 117 is in the open position, the contents will then reach the bristles of the brush as shown in detail in FIG. 16. When the pointer is rotated to the closed position and the contents 128 are sealed off as shown in FIGS. 20 and 21, the brush can then be pushed outward into its extended position. If the contents of the tube happen to be toothpaste, the user can brush his teeth by holding the combination brush and paste dispenser as shown in FIG. 19. The apparatus of the subject invention is also useful for other types of paste material dispensed from tubes, such as eyelash makeup, shoe polish, and wherever paste is generally applied by means of a brush.

Figure 23:
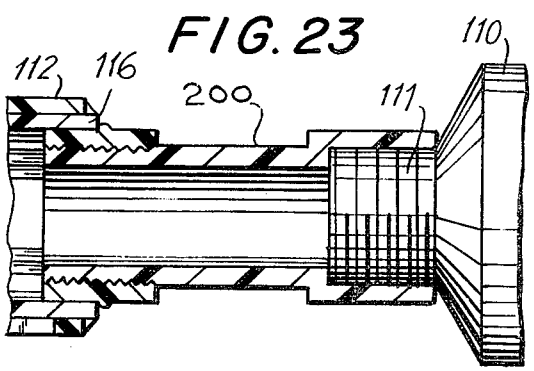
FIG. 23 is a longitudinal cross sectional view of the barrel shown in FIG. 22 and showing its attachment to a shorter tube of paste.
Figure 18:
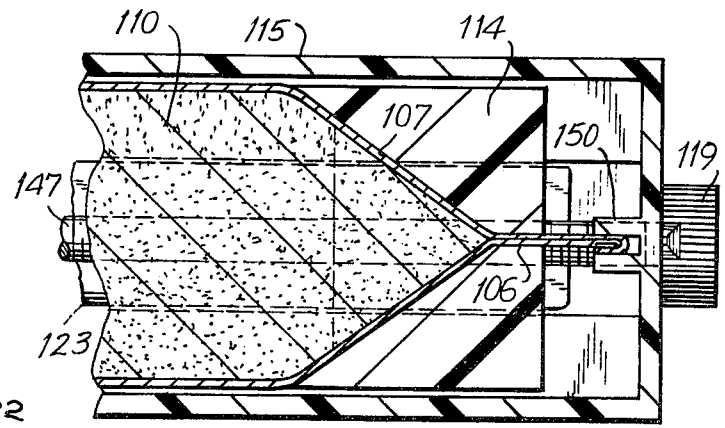
FIG. 18 is a cross-sectional view taken through section 18—18 of FIG. 15.
Figure 16:
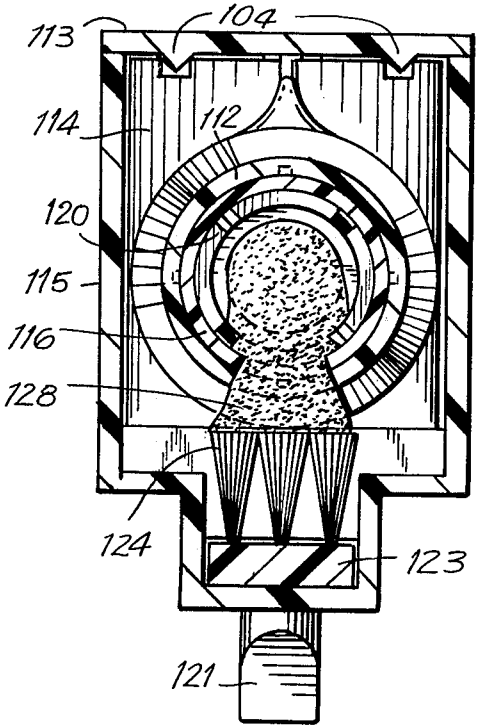
FIG. 16 is a cross-sectional view taken through section 16—16 of FIG. 15.
Figure 22:
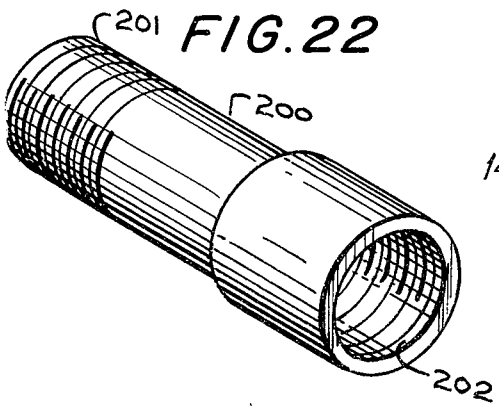
FIG. 22 is a prospective view of an extension barrel used in association with shorter tubes of paste.

FIG. 22 shows an extension barrel 200 having male threads 201 formed on one end and female threads 202 formed on the opposite end. As shown in FIG. 23, the extension barrel is useful for adapting shorter tubes of paste to fit into the devices of the first and second embodiments.

While only two embodiments of the present invention have been shown and described, it will be obvious that many changes and modifications may be made thereunto without departing from the spirit and scope of the invention.

What is claimed is:

1. A combination of brush and paste dispenser for dispensing a measured amount of paste from a tube onto a brush comprising:

a hollow elongated housing having a hinged outlet cover mounted on one end and a top cover providing access to the top of said housing;

a first compartment in said housing for receiving and securing the tube of paste;

paste applying means for coupling to the outlet of the paste tube and disposed above said hinged outlet cover;

a carriage slidably disposed in said housing and including a compression paddle for engaging the side walls of the paste tube;

a brush and handle combination slidably disposed in said housing with the brush being adjacent to said hinged outlet cover, said brush and handle combination having a pin connected to the handle and disposed through an elongated slot in said housing, and said brush portion being disposed adjacent to said brush applying means; and connection means coupling said handle to said carriage and for advancing said carriage and compression paddle with respect to said paste tube so that when the handle pin is pushed in the direction of said hinged outlet cover, said compression paddle will advance along the side of said paste tube causing paste to be dispensed from the tube outlet through said paste applying means onto said brush as the brush is advanced out of said hinged outlet cover.

2. The combination brush and paste dispenser as recited in claim 1 wherein said paste applying means comprises a first hollow cylinder mounted in said housing above said hinged outlet cover and having an opening along the side wall communicative to said brush, and having one open end communicative to a corresponding opening in said housing wall;

a second hollow cylinder slidably and coaxially disposed in said first cylinder through said housing opening and having a pointer formed at one end externally accessible on said housing, said second cylinder including a slot opening formed on a side wall for registration with the side wall opening of said first cylinder; and a third hollow cylinder coaxially disposed in one end of said second cylinder having slotted openings around its periphery and threadably engaged to the outlet of said paste tube so that the rotation of said second cylinder can cut off or communicate paste from the tube to the brush.

3. The combination brush and paste dispenser as recited in claim 1 wherein said brush handle includes a toothed rack disposed along its length.

4. The combination brush and paste dispenser as recited in claim 3 wherein said connection means of said carriage disposed above said handle includes a pawl engaging the toothed racks of said handle so that advancement of said brush handle will cause said pawl to engage the toothed rack and move said carriage an incremental distance in said housing.

5. The combination brush and paste dispenser as recited in claim 4 wherein said carriage includes a ratchet segment pivoted in said carriage and connected to said compression paddle, and a second pawl engaging said segment, a stop pin disposed at one end of the housing adjacent said brush, a threaded screw disposed through a wall at the opposite end of said housing and a butterfly paddle pivoted on said carriage and engaging said ratchet segment so that when said carriage approaches said stop pin, the stop pin will engage said butterfly paddle to advance the paddle over a few teeth of said ratchet segment and when said carriage approaches said threaded screw, the screw will engage the butterfly paddle to advance said ratchet segment a predetermined angular displacement and thus rotate said compression paddle with respect to the paste tube so that additional paste will be dispensed from the tube.

6. The combination brush and paste dispenser as recited in claim 3 wherein the teeth of said toothed rack of said handle are inclined in one direction so as to grip the carriage pawl only when the brush and handle are moved out of the housing.

7. The combination brush and paste dispenser as recited in claim 6 wherein said toothed rack includes slide release means for releasing the carriage pawl when the brush is returned inside of said housing.

8. A combination brush and paste dispenser for dispensing a measured amount of paste from a tube onto a brush comprising:

a hollow elongated housing having a hinged outlet cover mounted on one end and a top cover providing access to the top of said housing;

a first compartment in said housing for receiving and securing the tube of paste;

paste applying means for coupling to the outlet of the paste tube and disposed above said hinged oulet cover;

a lead screw disposed along the length of the housing having a knob externally accessable at one end of the housing for permitting manual rotation of the lead screw;

a sliding wedge threadably coupled to said lead screw having inclined surfaces separated by a slot and disposed on both sides of the paste tube for travelling along the length of the tube in response to rotation of the lead screw so that a measured amount of paste will be dispensed from said paste applying means;

a brush and handle combination slidably disposed in said housing with the brush being adjacent to said hinged outlet cover, said brush and handle combination having a pin connected to the handle and disposed through an elongated slot in said housing, said brush portion being disposed adjacent to said brush applying means.

9. The combination brush and paste dispenser as recited in claim 8 wherein said paste applying means comprises a first hollow cylinder mounted in said housing above said hinged outlet cover and having an opening along the side wall communicative to said brush, and having one open end communicative to a corresponding opening in said housing wall;

a second hollow cylinder slidably and coaxially disposed in said first cylinder through said housing opening and having a pointer formed at one end externally accessible on said housing, said second cylinder including a slot opening formed on a side wall for registration with the side wall opening of said first cylinder; and a third hollow cylinder coaxially disposed in one end of said second cylinder having slotted openings around its periphery and threadably engaged to the outlet of said paste tube so that the rotation of said second cylinder can cut off or communicate paste from the tube to the brush.

10. The combination brush and paste dispenser as recited in claim 8 wherein said lead screw additionally includes a pointer mounted on its external knob and graduations formed on said housing surrounding said pointer for indicating the displacement of said pointer when the screw is rotated.

11. The combination brush and paste dispenser as recited in claim 8 wherein said housing additionally comprises a top cover for closing across the length of the paste tube, said cover including a pair of spaced apart longitudinal rails, said sliding wedge having parallel spaced apart slots formed along one surface for engaging and sliding along said rails for maintaining alignment of the wedge during travel by the lead screw.

12. The combination brush and paste dispsenser as recited in claim 8 additionally comprising a cylindrical extension having a female thread formed at one end for threadably engaging the outlet of the paste tube and a male thread formed at its opposite end for threadably engaging said third hollow cylinder of said paste applying means so that paste tubes of different lengths can be accommodated in said housing.

* * * * *